US006013308A

United States Patent [19]

Saito

[11] Patent Number: 6,013,308

[45] Date of Patent: Jan. 11, 2000

[54] METHOD AND SYSTEM FOR REMOVING DEFECTS ON COATED SURFACE

[75] Inventor: Shigeki Saito, Shizuoka, Japan

[73] Assignee: Suzuki Motor Corporation, Hamamatsu, Japan

[21] Appl. No.: 08/906,262

[22] Filed: Aug. 5, 1997

[30] Foreign Application Priority Data

Aug. 5, 1996 [JP] Japan ..... 8-221733

[51] Int. Cl.[7] ..... B24B 49/00

[52] U.S. Cl. ..... 427/8; 118/670; 250/559.4; 250/559.42; 250/559.44; 250/559.45; 250/559.46; 451/6; 451/8

[58] Field of Search ..... 118/670; 250/559.4, 250/559.42, 559.44, 559.45, 559.46; 427/8; 451/6, 8

[56] References Cited

U.S. PATENT DOCUMENTS 5,135,303 8/1992 Uto et al. ..... 250/559.46 X 5,394,654 3/1995 Shimbara et al. .

*Primary Examiner*—Erma Cameron

*Attorney, Agent, or Firm*—Greenblun & Bernstein, P.L.C.

[57] ABSTRACT

A method for removing coating defects from a vehicle body or the like includes the steps of putting a defect information mark on a defect portion of an inspected object's coating, recognizing a position and a removal setting of the defect portion from the defect information mark, and non-contact removal of the defect portion in accordance with the position and the removal setting recognized in the recognizing step. According to the present invention, only the defects are removed, even when they are very small. The non-contact removal step may include spraying a water jet to permit removal of a defect without damaging a base coat. The non-contact removal step is very straightforward. Therefore, the removal position need not be defined in three dimensions. Accordingly, the shape of the vehicle body or the like is not required to be input.

24 Claims, 7 Drawing Sheets

METHOD AND SYSTEM FOR REMOVING DEFECTS ON COATED SURFACE

BACKGROUND OF THE INVENTION

1. Field of the Invention

The present invention relates to a method and a system for removing defects, and particularly to a method and a system for removing defects on a coated surface of a vehicle or a motorcycle.

2. Description of the Related Art

In a production line of vehicles or motorcycles, coating defects on a body thereof have been removed according to various methods. For example, once an operator finds a defect portion on the body in a coating inspection line, a paper tape is applied to the body and is put down from the line. The paper tape may show or indicate the kind of defect(s) that are present if required. The operator sees a position of the paper and the kind of defects shown on the paper to recognize a portion to be repaired. The coating of the portion is partially removed and recoated. The body is, then, returned to the line after the coating has dried.

Another known defect-removing system uses a sanding robot or the like instead of the operator for automatically removing coating defects. In this system, sanding and water washing are provided.

Unfortunately, the above-mentioned system cannot precisely remove defects due to the use of sanding as a means for removing the coating defects. Consequently, a good coating surface surrounding the defect is also removed, resulting in a considerable amount of unnecessary work required for removing, recoating and drying the area. Furthermore, unnecessary paint for recoating is also used. In addition, the sanding is apt to damage a base coat such as an anti-rust film.

SUMMARY OF THE INVENTION

An object of the present invention is to provide an improved method and an improved system for removing coating defects.

An other object of the present invention is to provide an improved system and an improved method for removing coating defects on a vehicle body.

An other object of the present invention is to provide a method and a system for removing only minute coating defect portions.

An another object of the present invention is to provide a method and a system for removing coating defects while preventing less damage to a base coat.

A still further object of the present invention is to provide a method and a system for automatically removing coating defects.

Another object of the present invention is to provide a method and a system for removing coating defects without inputting shape information of a vehicle body in advance.

According to the present invention, a method for removing coating defects of an inspected object is composed of the steps of: putting a defect information mark on a defect portion of the coating of the inspected object, recognizing a position and a remove setting of the defect portion from the defect information mark, and non-contact removing the defect portion in accordance with the position and the remove setting recognized in the mark recognizing step. The defect information mark putting step may be performed by either an operator using a pen or an automatic marking by a defect inspection device. The mark recognition step includes the steps of recording an image using a TV camera or a CCD camera, and recognizing and processing the image obtained, or detecting a thickness of the mark using a laser range finder to obtain an image and processing the image, or the like. In the non-contact removing step, the defect portion is not removed by direct contact, but rather is removed by an indirect contact via water, light or the like. For example, an water jet processing machine, a laser processing machine or the like is used. With these non-contact processing means, the defect portion is narrowly targeted by reducing a diameter of the water jet or a laser light. Furthermore, only the surface is processed due to the non-contact, resulting in less damage to the base coat.

The mark recognition step correlates the position information with the non-contact removing step. Therefore, it is desirable that the mark recognition step has the step of outputting the position information at a predetermined plane. In other words, the non-contact removing step does not require depth information, and uses the position information from the plane of the surface being repaired. Thus, no detailed shape information about the inspected object is needed.

In addition, to specify a micro defect position satisfactorily, it is desirable that the defect information mark putting step includes the step of attaching a closed loop surrounding the defect portion on the inspected object. Also, the mark recognition step includes the step of outputting a coordinate of an area closed with the closed loop as the position information of the defect portion, when the closed loop is extracted. The closed loop maybe in a shape of a circle. The closed shape may also be another shape such as a rectangle. Then, a stamp can be used for marking the closed loop. The stamping may be made by either the operator or the defect inspection device.

To remove the defects in accordance with the present invention, it is desirable that the defect information mark putting step includes the step of attaching a painted mark having a predetermined shape to the inspected object. It is also preferable that the mark recognition step includes the step of outputting predetermined setting information, when the predetermined shape is extracted, depending on the number of the shapes.

In a preferred embodiment, the non-contact removing step includes the step of spraying a water jet to remove the micro defect portion without damaging the base coat. The step of spraying the water jet may further include the step of mixing an abrasive into water.

To adjust a scan speed of the water jet by utilizing the mark, it is desirable that the defect information mark putting step includes the step of attaching a predetermined painted mark having a first shape to the inspected object, and that the mark recognition step includes the step of outputting scan speed setting information of the water jet, when the first shape is extracted, depending on the number of the shapes.

To adjust the jet types of the water jet, for example, a nozzle diameter, water pressure or the like, by utilizing the mark, it is desirable that the defect information mark putting step includes the step of attaching a predetermined painted mark having a second shape to the inspected object. Furthermore, the mark recognition step should include the step of outputting jet type setting information, when the second shape is extracted, depending on the number of the shapes.

To handle an entire wide coated surface, such as that of the vehicle body, it is desirable that the mark recognition step includes the steps of detecting whether or not there is a mark by using a fixed camera, recording the mark image which is enlarged by a driven camera, and outputting posture information of the driven camera and position information of the closed loop on a recorded image. In this case, the non-contact remove step includes the steps of setting a coordinate at a position corresponding to the posture information of the driven camera, and spraying to the coordinate position of the closed loop. The mark attached to each portion of the vehicle can be accurately recognized.

For more detail of the defect processing, the defect information mark putting step may include the steps of stamping a circular mark on the micro coating defect portion and marking a closed loop with a pen against a coating flow.

If the defect information mark putting step includes the step of marking with a fluorescent paint, and if the mark recognition step includes the steps of irradiating an ultraviolet (UV) ray to the inspected object and photographing the surface of the inspected object where the UV ray is irradiated, the mark can be successfully recognized, even under poor lightning conditions. Further, if the fluorescent paint is aqueous, the paint can be easily removed by simply washing it.

Furthermore, the water jet allows easy removal of the micro defect portion by reducing the diameter of the water jet using the nozzle.

The defect information mark is a (closed) remove area mark surrounding the remove area. The remove area mark is larger than the remove area, resulting in easy recognition of the remove area mark.

Moreover, because the defect information mark is a (closed) remove area mark surrounding the remove area, it can correspond to any area such as micro defect and a large defect and it never removes a nondefective coating.

Information showing a remove speed and jetting conditions may be added to the defect information mark. In accordance with the information, the defects are more precisely removed by the water jet.

The defect information mark is easily recognized for the reason that a fluorescent substance is light-emitted and is distinguishable from a coating color. In addition, the defect information mark may comprise an aqueous paint, which can be easily removed by water.

According to the present invention, a method for removing coating defects on a vehicle body comprises the steps of: capturing an image of an engine hood, a roof and a trunk lid with a plurality of wide range cameras fixed on a line; detecting whether or not there is a mark indicating coating defects by referring to images taken by the wide range cameras; activating a robot supporting a mark pick-up camera at the mark position once the mark is detected; photographing the mark with the mark pick-up camera, recognizing a kind of mark from the image taken by the mark pick-up camera; outputting remove control information in accordance with the kind of mark recognized, and removing the coating defects in accordance with the remove control information.

Preferably, the above-described method is, for example, further composed of the steps of: taking an image of a surface of the body with the plurality of wide range cameras fixed on the line detecting whether or not there are coating defects by referring to an image taken by the wide range camera; detecting an area of the coating defects once the coating defects are found; positioning a coating defect pick-up camera to the coating defects area; and recognizing a position and a size of the coating defects from the image taken by the coating defect pick-up camera.

In this case, to spray a water jet accurately at the defect position recognized by the image processing, the method further comprises: setting a scan speed and a nozzle diameter of the water jet depending on a size of the coating defect; positioning the nozzle of the water jet to a sample planar with that of a position of the image of the coating defects taken by a camera robot; positioning the nozzle to the coating defects position within the planar, and spraying the water jet with the scan speed and the nozzle diameter that are set.

According to the present invention, closely relating to the above-mentioned method, there is a system for implementing the method. The system for removing the coating defects of the inspected object comprises means for taking an image of the inspected object; means for detecting a predetermined specific shape from an image of the inspected object taken, a means for determining the are within the closed loop as the coating defects when the closed loop is extracted and determining the specific shape as the remove control information when the specific shape is extracted; a means for receiving the position information of the coating defects and the remove control information from the determining means; and means for non-contact removal of the defect portion of the inspected object in accordance with the position information and the control information.

According to the system, when the defect information mark is marked with an aqueous paint including a fluorescent substance, photographing and removing thereof can be easily and accurately performed. In this case, the non-contact removal means is composed of means for scanning an inner portion of the closed loop with the water jet to remove the micro defect portion only, and means for washing an outside portion of the closed loop by water to remove the mark. In addition, the determining means is composed of means for producing speed control information based on the number of the specific shapes when the specific shape is extracted, and the scanning means using the water jet is composed of means for scanning at a speed in accordance with the speed control information corresponding to the number of the shapes.

The system of the present invention can remove the defects in a micro area easily. Accordingly, the time required for removing, recoating and drying can be shortened and the amount of the paint for recoating can be reduced. In addition, the non-contact processing realizes a surface-only finishing to prevent damage to a rust preventative film or the like of the base coat. Moreover, the non-contact remove means may be the water jet. Therefore, the micro area can be easily removed by reducing the diameter of the water jet using the nozzle. Furthermore, the defect portion is removed by water to prevent scattering of powder effectively. Consequently, an operation environment can be improved and reattachment of the powder to the inspected object can be prevented.

DETAILED DESCRIPTION OF THE PREFERRED EMBODIMENTS

Figure 1:
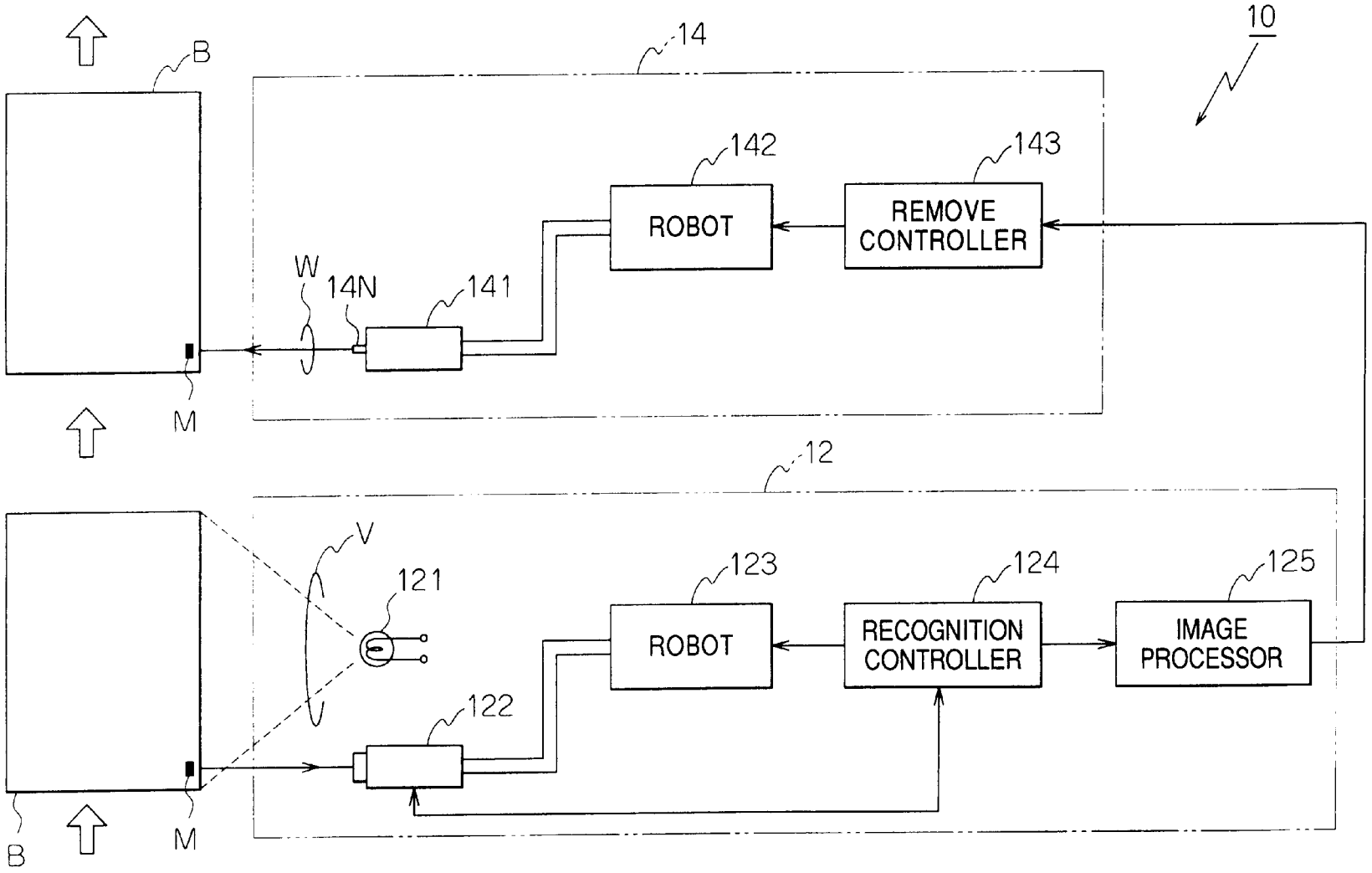
FIG. 1 is a functional block diagram showing one embodiment of a defect removing system according to the present invention.
Figure 2:
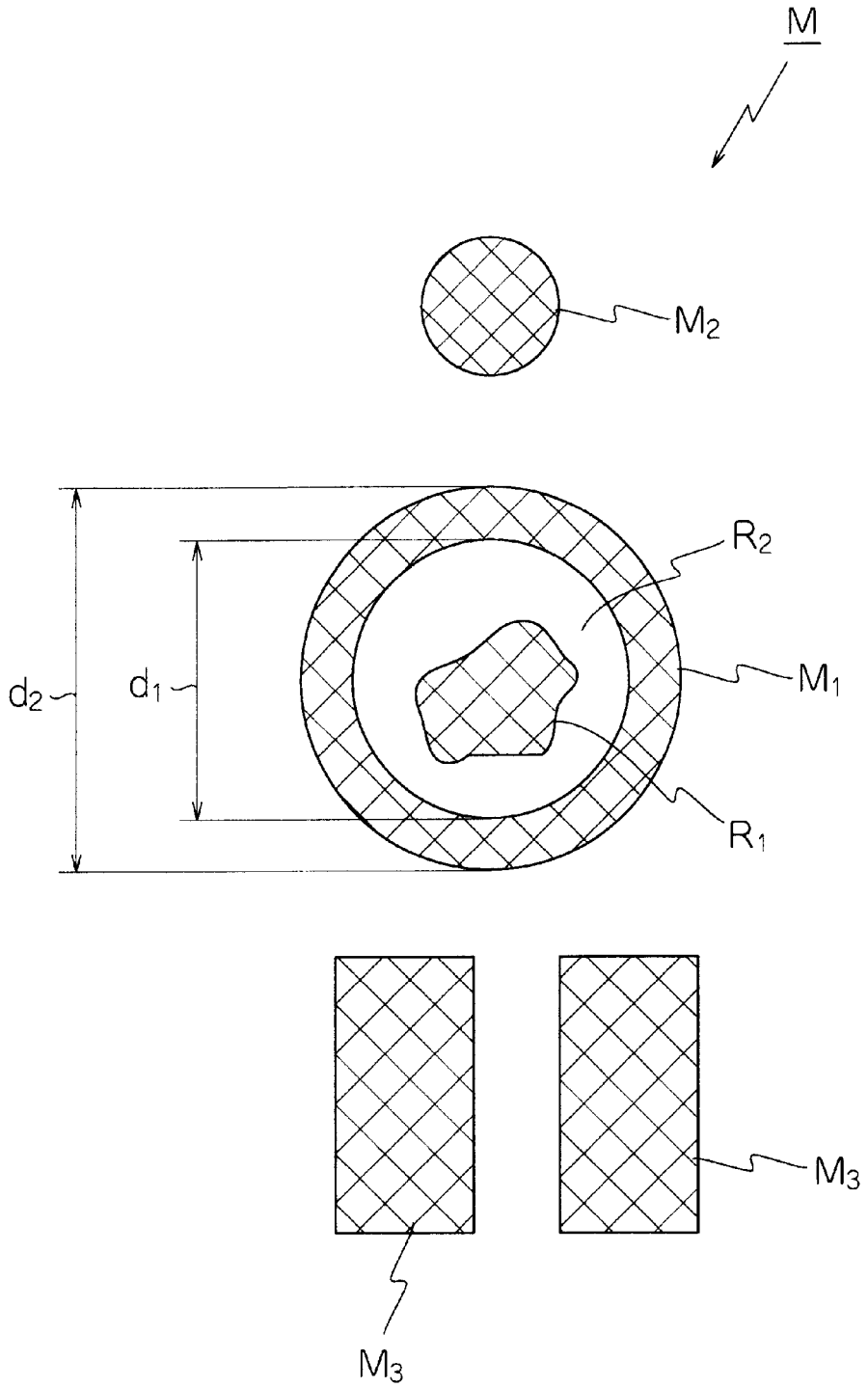
FIG. 2 is an enlarged plan view of an example of defect information marks used in the defects removing system of FIG. 1.

FIG. 1 shows a mark recognition means 12 for recognizing a defect information mark M attached to a vehicle body B which is an inspected object, also shown is a water jet robot 14 which is a non-contact processing means for removing a defect portion R1 (FIG. 2) from the body B with no contact in accordance with the defect information mark M recognized by the mark recognition means 12. As shown in FIG. 2, the defect information mark M includes a removal area mark M1 specifying the defect portion R1 and a surrounding removal area R2 (including the defect portion R1. Also shown is a removal speed mark M2 for specifying a removal speed for a water jet W (FIG. 1), in other words, a scan speed of a nozzle 14N. A jet type mark M3 for specifying the strength, the shape, or the like of the water jet W is also provided.

The removal area mark M1 is torus shaped having an inside diameter d1 and an outside diameter d2 and includes the removal area R2. Thus, a size of the removal area mark M1 is changed depending on a size of the removal area R2 and is always greater than that of the removal area R2. Therefore, the removal area mark M1 is easily recognized in the image processing.

The removal speed mark M2 is circular and the number thereof exhibits a removal speed. The jet type mark M3 is rectangular and the number thereof exhibits, for example, spray strength. The removal speed mark M2 and the jet type mark M3 are disposed adjacent to the removal area mark M1. Preferably, shapes of the removal speed mark M2 and the jet type mark M3 are simple in order to facilitate easy recognition, and have distinct features to avoid confusing them. The removal speed mark M2 and the jet type mark M3 can be omitted. In this case, standard removal speed and jet types are preset. If the numbers of the removal speed mark M2 and the jet type mark M3 are set between 0 and 3 respectively, sixteen (4×4) combinations thereof can be set as the removal conditions.

Figure 3A:
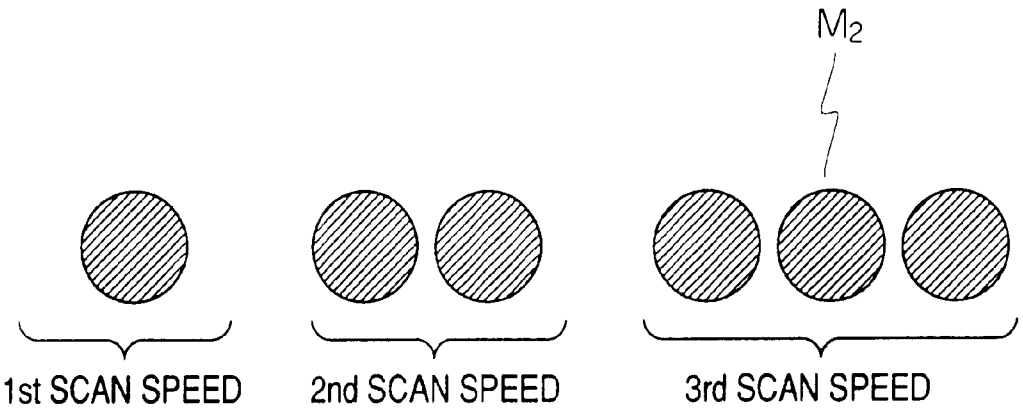
FIGS. 3A and 3B are plan views showing an example of the defect information marks for controlling a scan speed and another parameter of the water jet.
Figure 3B:
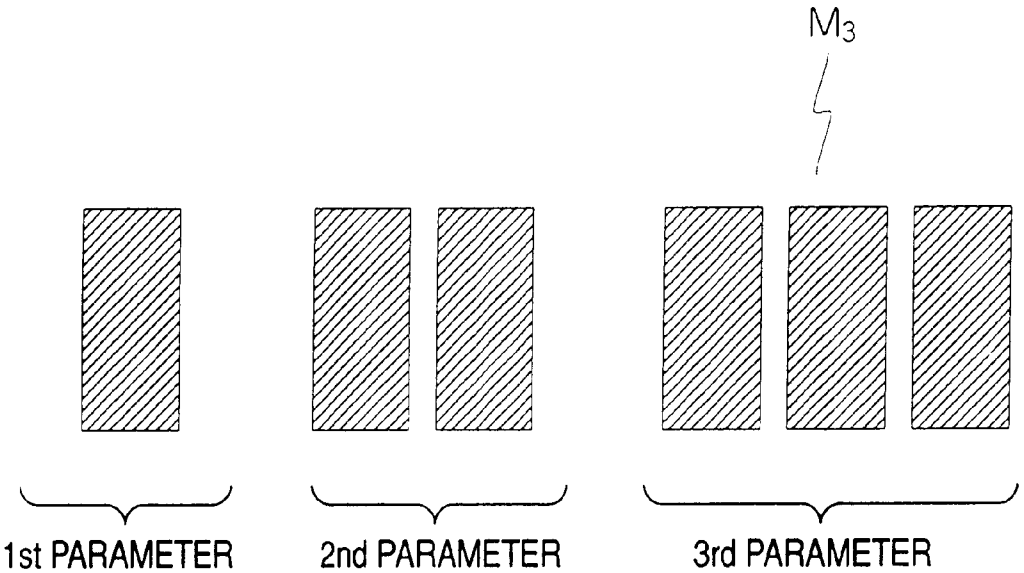

The number of removal speed marks M2 and jet type marks M3 represent information, for example, the information shown in FIG. 3. In this embodiment, the mark is stamped and recognized in such a way shown in FIG. 3.

Figure 4:
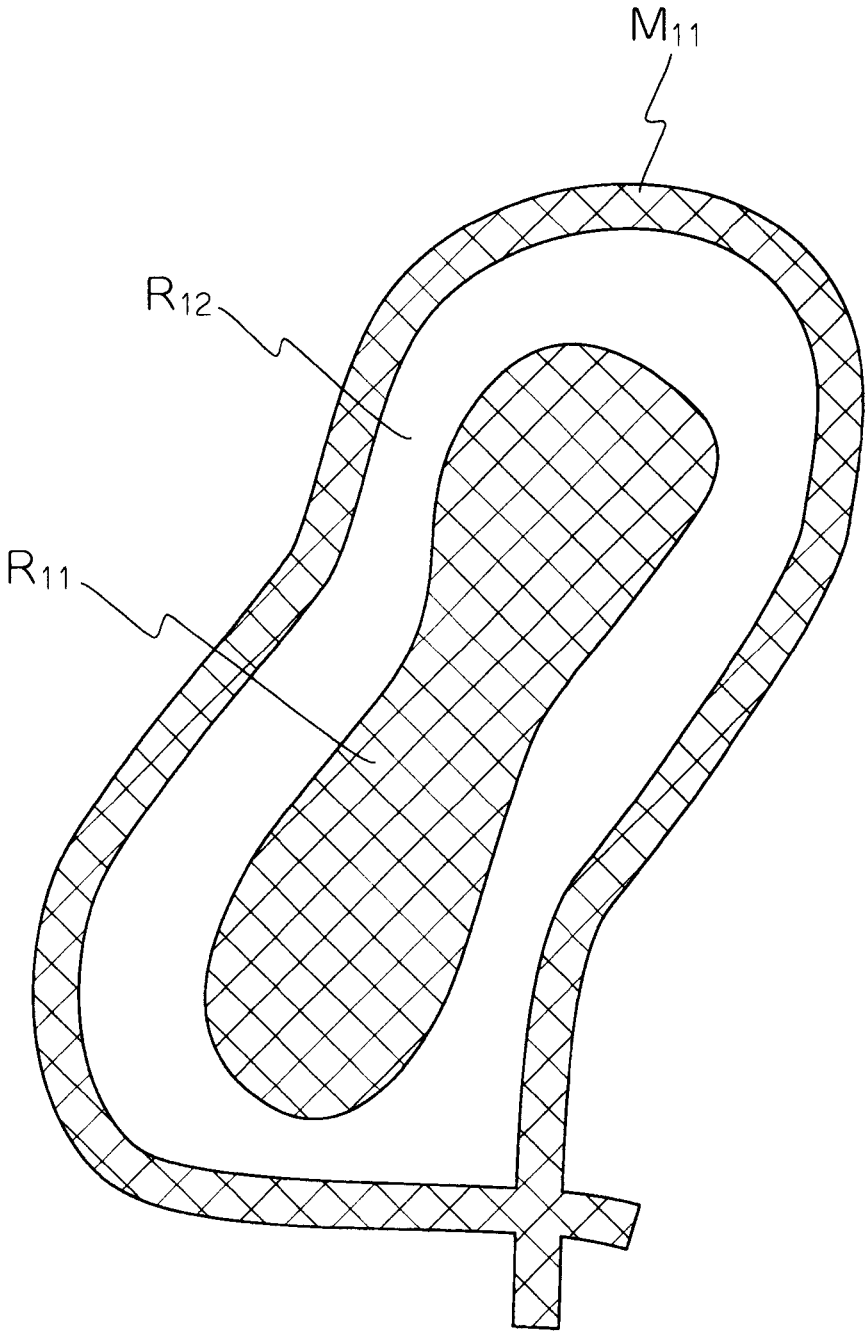
FIG. 4 is an enlarged plan view showing the defect information mark enclosed by a closed loop.

Referring to FIG. 4, a removal area mark M11 encloses a remove area R12' including a defect portion R11, with an elongated loop. Thus, a shape of the removal area mark M11 is not limited to be torus shaped. Any shape may be allowed as long as the removal area mark M11 encloses the remove area R12 and is a closed loop. In the embodiment shown in FIG. 4, the removal area mark M11 is inscribed with a felt pen.

The defect information mark M may also be painted with an aqueous paint including a fluorescent substance. The fluorescent substance emits lights upon receiving a UV ray.

Referring back to FIG. 1, the mark recognition means 12 is composed of, for example, an UV lamp 121 for embossing the defect information mark M, a CCD camera 122 for inputting an image including the defect information mark M, a robot 123 mounted to the CCD camera 122, a recognition controller 124 for controlling the CCD camera 122 and the robot 123, and an image processor 125 for extracting the defect information mark M based on the image obtained through the CCD camera 122 to specify a position of the defect information mark M.

The recognition controller 124 and the image processor 125 are composed of, for example, a microcomputer and are operated by a control program and an image processing program, respectively.

The water jet robot 14 is composed of, for example, an water jet processing machine 141, a robot 142 mounted to the water jet processing machine 141 and a removal controller 143 for controlling the water jet processing machine 141 and the robot 142. The water jet processing machine 141 refers to a machine tool for processing by spraying water from the nozzle 14N with high pressure. The remove controller 143 is composed of, for example, a microcomputer and is operated by a control program.

Following an embodiment of the defect removal system 10 described.

The defect information mark M may be attached to the body B by a visually inspecting operator or system. A conveyor then carries the body B in front of the mark recognition means 12. The UV lamp 121 radiates UV rays onto the whole body B. The defect information mark M receives the UV rays and emits light. The status is then recorded by the CCD camera 122. The Robot 123 moves the CCD camera 122 in three-dimensions. The CCD camera 122 then outputs image signals of the whole body B to the recognition controller 124. The image processor 125 inputs the image signals and position information of the CCD camera 122 from the recognition controller 124, extracts the defect information mark M from the image signals, calculates a position coordinate of the removal area R2 from the removal area mark M1 and decodes the removal speed and the jet types from the removal speed mark M2 and the jet type mark M3. The removal area mark M1 should be large enough to be recognized easily. Once the removal area mark M1 is recognized, the removal speed mark M2 and the jet type mark M3 therearound can also be easily recognized. Because the defect information mark M is light-emitting, the defect information mark M can be extracted depending on a degree of the light intensity output to the removal. Accordingly, the defect information mark M is extremely easily recognized. In this way, the information obtained in the image processor 125 is output to the removal controller 143.

Then, the body B is carried in front of the water jet robot 14. The removal controller 143 controls the robot 142 and the water jet processing machine 141 based on the information input from the image processor 125. In other words, the nozzle 14N of the water jet processing machine 141 is moved at a designated scan speed within the removal area R2 via the robot 142 to spray the water jet W within the removal area R2 according to the specified jet type. A diameter of the water jet W can be easily reduced by the nozzle. Therefore, micro remove area R2 can also be removed. The water jet processing machine 141 does not directly contact the removal area R2 unlike a sanding machine. Consequently, a base coat of the removal area R2 is unlikely to be damaged.

Figure 5:
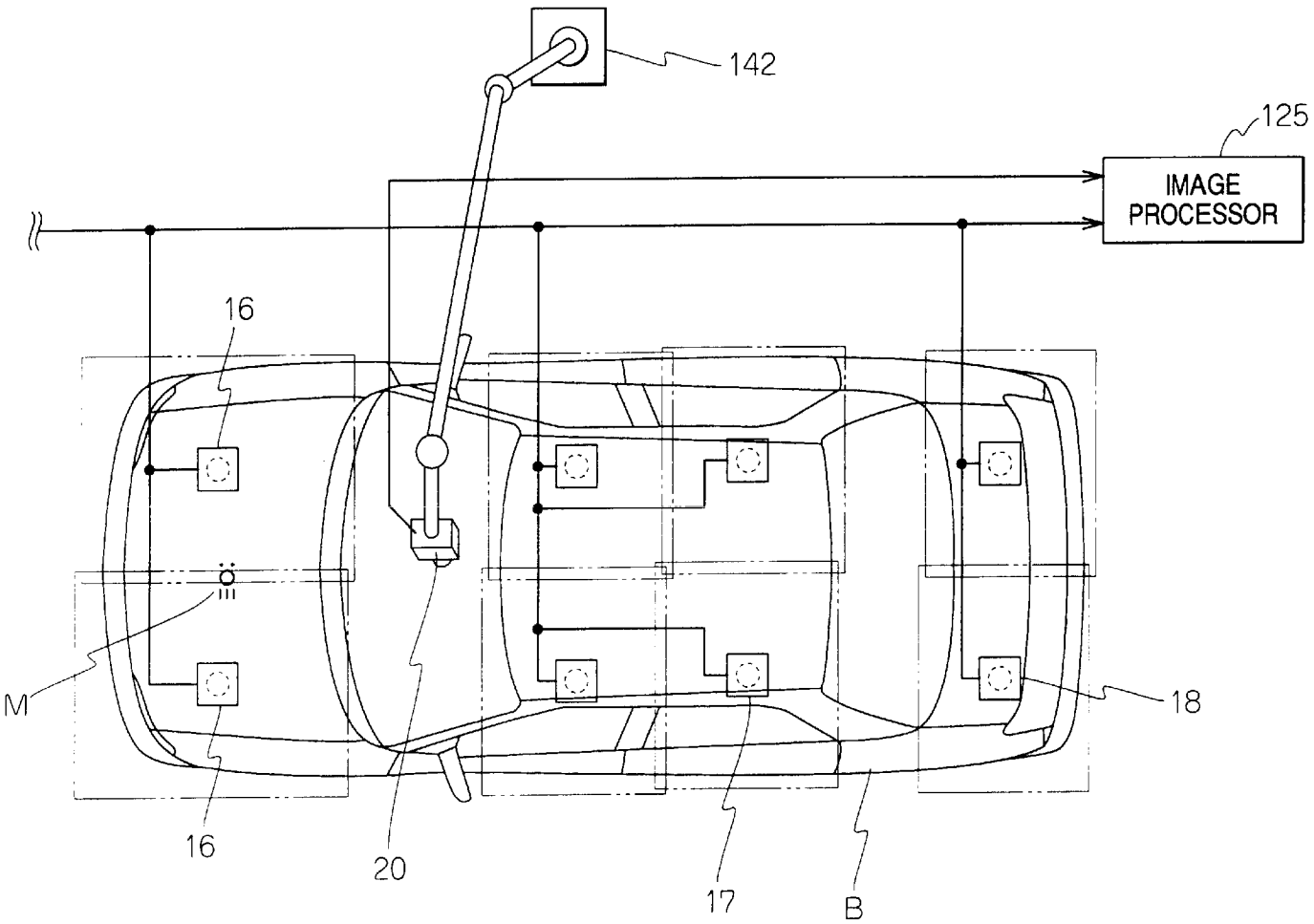
FIG. 5 is a block diagram showing one embodiment of a system for removing coating defects from a vehicle body.

Referring to FIG. 5, to remove coating defects from a four-wheeled vehicle body, a plurality of cameras is used. In the embodiment shown in FIG. 5, two CCD cameras 16 are focused on an engine hood, four CCD cameras 17 on a roof and two CCD cameras 18 on a trunk lid. Respective photograph areas are shown by chain double-dashed lines. When the mark is recognized within the camera range, the body surface having the mark is recorded by a mark pick-up camera 20. Accordingly, the mark can be photographed with a sufficient magnification for image processing, even if the mark M is attached where both camera ranges 16 are overlapped as shown in FIG. 5 or if the mark is small.

Output from the respective cameras are input to the image processor 125. Depending on the recognition result from the image processor 125, the robot 142 is driven. In addition, if the mark pick-up camera 20 photographs, records, or takes an image of the mark, posture information of the mark pick-up camera is stored. In other words, if the robot 142 supporting the mark pick-up camera 20 has, for example, five axes, angle information for each of the five axes is stored. The angle information is used for controlling the robot 142 supporting the water jet.

Figure 6A:
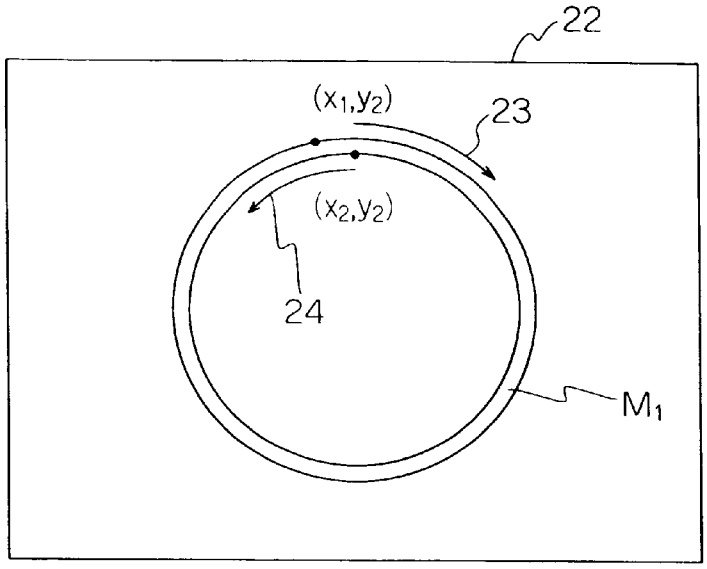
FIGS. 6A, 6B and 6C are illustrations examples of image processing.

When the mark pick-up camera is positioned on the mark, zooming is then performed. The mark pick-up camera photographs around and at a constant distance from the closed loop to verify whether or not the remove speed mark M2 and the jet type mark M3 are attached. Referring to FIG. 6A, in the closed loop image recognition, if scanning begins at an upper left pixel, a pixel being at (x1, y1) is first found. Once the pixel is found, it tracks, for example, in a clockwise direction 23, how far an outside perimeter from the pixel continues. After tracking around the perimeter, it reaches the initial pixel at (x1, y1). If it does not reach the initial pixel, the outside perimeter is not a closed loop. After tracing the outside perimeter, its pixel column and an approximate function thereof are stored.

Scanning continues in scanning direction (value y) of the initial pixel at (x1, y1) to a downward direction to find an end pixel at (x2, y2). Then, it tracks, for example, counter-clockwise 24 to extract an inside perimeter. Pixel column and an approximate function of the inside perimeter are also stored. If the tracking directions of the outside and the inside perimeters are different in capturing the closed loop, the closed loop can be clearly defined and handled in the processing thereafter. Needless to say, various methods for extracting the closed loop by the image processing are known and widely used by those skilled in the art. Therefore, suitable methods are applicable to the present invention.

Figure 6B:
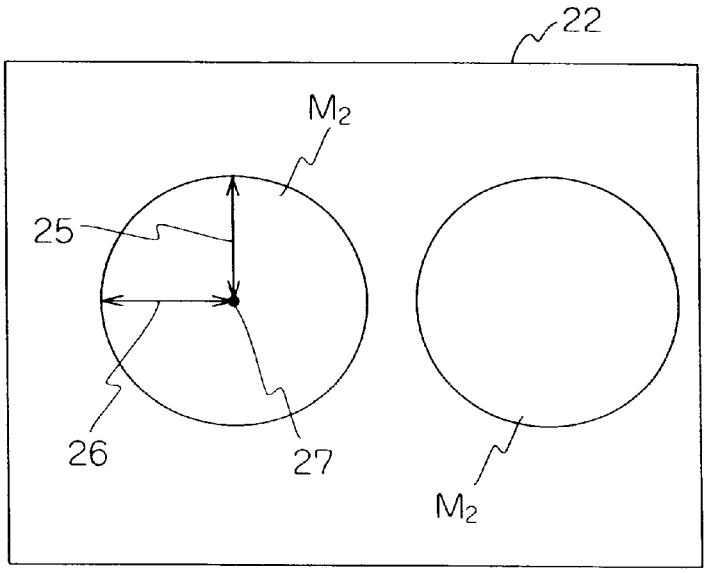
Figure 6C:
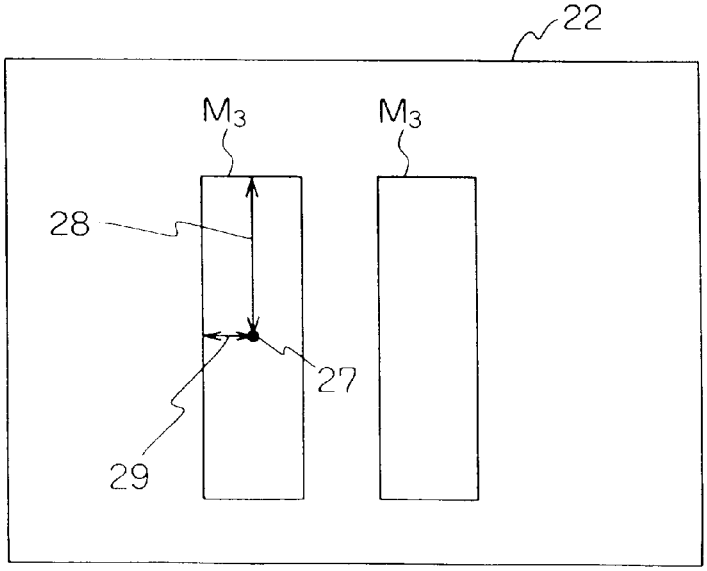

One embodiment of recognition processing of the painted mark having a peculiar shape will be described referring to FIGS. 6B and 6C. To avoid influence of size or noise, a distance from a center to a perimeter, for example, is utilized. In a circle M2 of FIG. 6B, a distance 25 from a center 27 to an upper end and a distance 26 from the center to a left end are approximately the same. On the other hand, in a rectangle M3 of FIG. 6C, a distance 28 and a distance 29 have an entirely different ratio. Utilizing this fact, individual shapes can be recognized quickly and certainly. Of course, any other methods known by those skilled in the art, for example, overlapping with a predetermined shape, may be used for extracting the shape.

Figure 7:
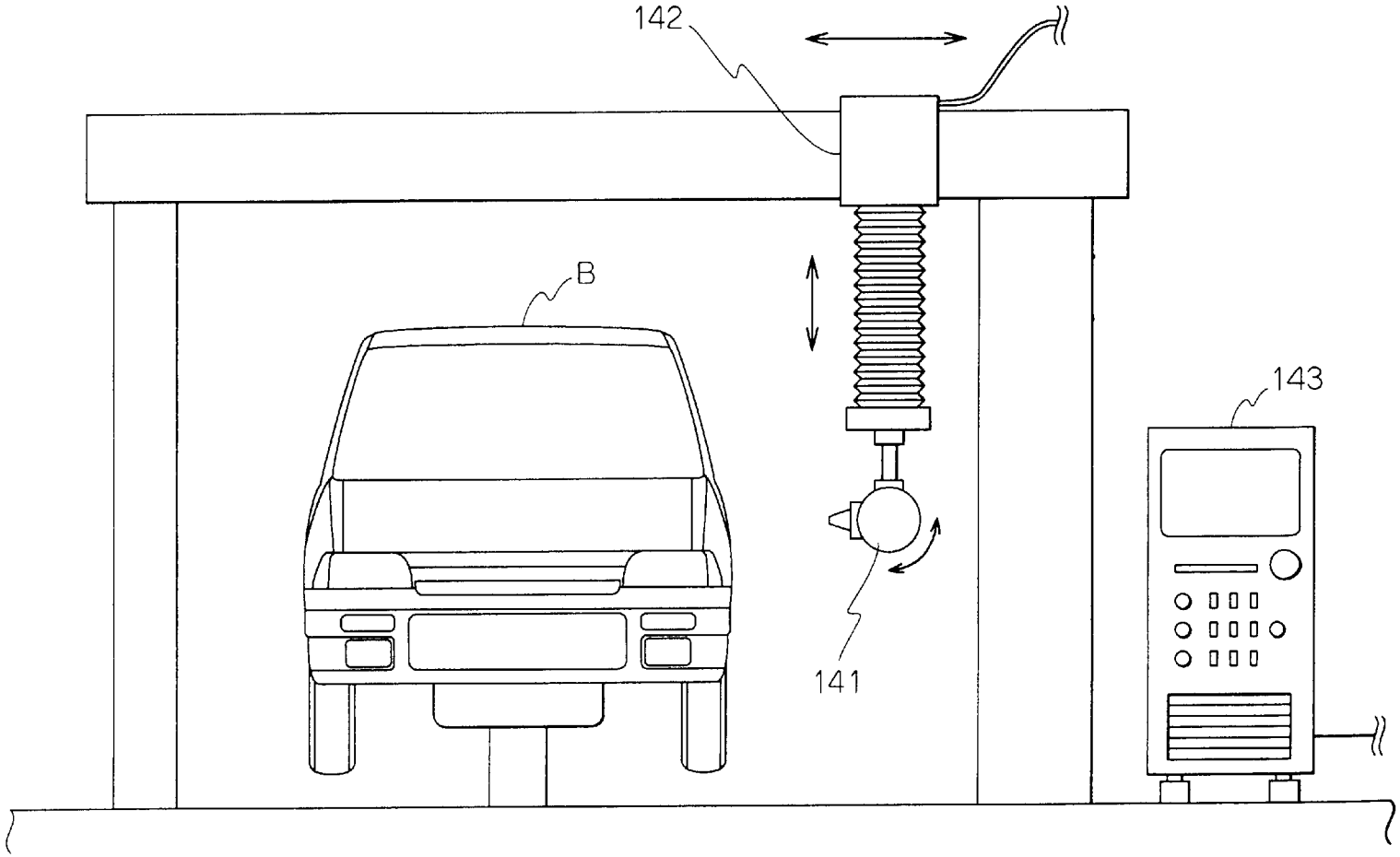
FIG. 7 is an illustration showing an example of a non-contact removal means using an water jet.

As shown in FIG. 7, the water jet processing machine 141 is held by the robot 142 that is disposed straddling the vehicle body. The robot is controlled by the removal controller 143. The water jet processing machine 141 is first positioned approximately the marked area, and a jet angle thereof is then determined based on the result of the image processing. For removing micro defects, it is desirable that the water jet scans only inside the closed loop.

According to this embodiment, a detailed shape of the vehicle body is relevant because of the non-contact system of the present invention. In other words, the removal is not specified with three-dimensional points, but with a certain plane and its two-dimensional coordinates. Even in the two-dimensional coordinates, the water jet sprays, or the laser radiates straight, thereby accurately removing only the micro defects. Thus, no three-dimensional positioning is needed using the non-contact system. Consequently, no body shape of the vehicle is required to be input in advance. According to this embodiment, if the body shape of the vehicle is changed, the defects can be removed without alteration.

Preferably, the mark pick-up camera 123 stores the posture information of the recorded closed loop. The water jet robot is driven so as to be in the same posture as the posture information. The water jet processing machine 141 is directed to the same posture and direction as the mark pick-up camera 123, and its jet angle is then controlled in accordance with the recognition result of the image processing. In other words, the angle of the water jet is determined in view of a zoom ratio of the mark pick-up camera and the position of the closed loop.

While the described embodiments represent the preferred form of the present invention, it is to be understood that the present invention is not limited thereto. For example, the inspected object is not limited to a vehicle body and may be a chassis or the like instead. The CCD camera as the mark recognition means may be incorporated into the water jet processing machine itself. Moreover, the present invention is applicable, for example, to defects caused by contamination, foreign materials or the like as well as coating defects.

What is claimed is:

1. A method for removing a defect from a coating of an inspected object, comprising:

putting a defect information mark on a defect portion on the coating of the inspected object, recognizing a position and a removal setting of the defect portion from the defect information mark, and non-contact removing the defect portion in accordance with the position and the removal setting recognized in the recognizing step.

2. The method according to claim 1, wherein the mark recognition step further comprises the step of outputting a position information at a predetermined plane.

3. The method according to claim 1, wherein the defect information mark putting step further comprises attaching to the inspected object a closed loop enclosing the defect portion, and wherein the recognition step further comprises outputting coordinates of an area enclosed by the closed loop as position information of the defect portion, when the closed loop is extracted.

4. The method according to claim 3, wherein the closed loop enclosing the defect portion is a circle enclosing the defect portion.

5. The method according to claim 1, wherein the defect information mark putting step further comprises stamping one of a closed loop, a circle and a rectangle by predetermined stamps.

6. The method according to claim 1, wherein the defect information mark putting step further comprises the step of attaching a painted mark having a predetermined shape to the inspected object, and wherein the recognition step further comprises the step of outputting predetermined setting information depending on number of the shapes, when the predetermined shape is extracted.

7. The method according to claim 1, wherein the non-contact removal step further comprises spraying a water jet.

8. The method according to claim 7, wherein the spraying step further comprises mixing an abrasive into water.

9. The method according to claim 7, wherein the defect information mark putting step further comprises attaching a painted mark having a predetermined first shape to the inspected object, and wherein the mark recognition step further comprises outputting scan speed setting information for the water jet depending on the number of the shapes, when the predetermined first shape is extracted.

10. The method according to claim 7, wherein the defect information mark putting step further comprises attaching a painted mark having a predetermined second shape to the inspected object, and wherein the mark recognition step further comprises outputting jet type setting information for the water jet depending on the number of the shapes, when the predetermined second shape is extracted.

11. The method according to claim 6, wherein the recognition step further comprises:

determining whether or not there is a mark by using a fixed camera, if the mark is found, enlarging an image of the mark by using a driven camera, and outputting position information of the driven camera and position information of the closed loop in the image, and wherein the non-contact removal step further comprises:

setting coordinates at a position in accordance with the position information of the driven camera, and spraying the position of the closed loop at the coordinates.

12. The method according to claim 1, wherein the defect information mark putting step further comprises:

stamping a circular mark on a micro defect portion on the coating, and marking the circular mark with a pen against a coating flow.

13. The method according to claim 12, wherein the defect information mark putting step further comprises marking with fluorescent paint, and wherein the recognition step further comprises:

irradiating the inspected object with a beam of ultraviolet light, and taking an image of the surface of the inspected object where the ultraviolet light beam is irradiated.

14. The method according to claim 12, wherein the fluorescent paint is aqueous.

15. A method for removing a coating defect on a vehicle body, comprising:

taking an image of an engine hood, a roof and a trunk lid with a plurality of wide cameras fixed on a line, determining whether or not there is a mark showing a defective coating by referring to images taken by the wide angle cameras, activating a robot supporting a mark pick-up camera at the mark position when the mark is detected, taking an image of the mark with the mark pick-up camera, recognizing a kind of mark from the image taken by the mark pick-up camera, outputting removal control information in accordance with the kind of mark recognized, and removing the coating defect in accordance with the removal control information.

16. The method according to claim 15, wherein the recognizing step further comprises setting a scan speed and a nozzle diameter of a water jet depending on a size of the coating defect, and wherein the coating defect removal step further comprises positioning the nozzle of the water jet towards a plane corresponding to a position of the image of the coating defects taken by the mark pick-up camera, positioning the nozzle towards the coating defect position within the plane, and spraying the water jet with the set scan speed and the set nozzle diameter.

17. A system for removing a coating defect of an inspected object, comprising:

means for obtaining an image of the inspected object, means for detecting a predetermined specific shape from the image of the inspected object, means for determining the area within a closed loop as the coating defect when the closed loop is extracted and determining the predetermined specific shape as removal control information when the specific shape is extracted, means for receiving position information of the coating defect and removal control information from the determining means, and means for non-contract removal of the defect portion of the inspected object in accordance with the position information and the control information.

18. The system according to claim 17, wherein the defect information mark is an aqueous paint including a fluorescent substance.

19. The system according to claim 18, wherein the non-contact removal means further comprises means for scanning an inner portion of the closed loop with the water jet, and means for washing an outside portion of the closed loop by water.

20. The system according to claim 18, wherein the determining means further comprises means for producing speed control information based on the number of specific shapes when the specific shape is extracted, and wherein the scanning means using the water jet further comprises means for scanning at a speed in accordance with the speed control information corresponding to the number of shapes.

21. A system for removing a coating defect of an inspected object comprising:

a system which obtains an image of the inspected object, a system which detects a predetermined specific shape from the image of the inspected object, a system which determines the area within a closed loop as the coating defect when the closed loop is extracted and determines the predetermined specific shape as removal control information when the specific shape is extracted, a system which receives position information of the coating defect and removal control information from the determining system, and a system for non-contact removal of the defect portion of the inspected object in accordance with the position information and the control information.

22. The system according to claim 21, wherein the defect information mark is an aqueous paint.

23. The system according to claim 21, wherein the non-contact removal system further comprises a system which scans an inner portion of the closed loop with the water jet, and a system which washes an outside portion of the closed loop with water.

24. The system according to claim 22, wherein the determining system further comprises a system which produces speed control information based on the number of specific shapes when the specific shape is extracted, and wherein the scanning system comprises a system which scans at a speed in accordance with the speed control information corresponding to the number of specific shapes.

* * * * *

UNITED STATES PATENT AND TRADEMARK OFFICE

CERTIFICATE OF CORRECTION

PATENT NO. : 6,013,308
DATED : January 11, 2000
INVENTOR(S) : S. Saito

It is certified that error appears in the above-identified patent and that said Letters Patent is hereby corrected as shown below:

Column 9,
Line 62, after "wide" insert -- angle --.

Column 10,
Line 7, before "removing" insert -- non contact --.
Line 34, "non-contract" should be -- non-contract --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*